US005477760A

United States Patent [19]

Kuchler

[11] Patent Number: 5,477,760

[45] Date of Patent: Dec. 26, 1995

[54] SLICEABLE PRODUCT CARRIAGE FOR A SLICING MACHINE

[76] Inventor: Fritz Kuchler, Klatteweg 4, A-9010 Klagenfurt, Austria

[21] Appl. No.: 400,130

[22] Filed: Mar. 6, 1995

Related U.S. Application Data

[63] Continuation of Ser. No. 77,884, Jun. 15, 1993, abandoned.

[30] Foreign Application Priority Data

Jun. 15, 1992 [AT] Austria ..... A 1218/92

[51] Int. Cl.[6] ..... B26D 1/18

[52] U.S. Cl. ..... 83/58; 83/717; 83/720; 83/731; 83/435.1; 83/730; 83/468.7

[58] Field of Search ..... 83/58, 62, 368, 83/714, 715, 717, 718, 719, 720, 721, 731, 707, 435.1, 730, 468.7, 268

[56] References Cited

U.S. PATENT DOCUMENTS

| | | | |
|---|---|---|---|
| 1,310,262 | 7/1919 | Van Berkel | 83/717 |
| 2,415,233 | 2/1947 | Brustowsky | 83/731 |
| 2,459,200 | 1/1949 | Teague, Jr. et al. | 83/719 |
| 2,859,785 | 11/1958 | Stolbach | 83/717 |
| 3,503,428 | 3/1970 | Ackerfeldt | 83/707 |
| 4,434,692 | 3/1984 | Desert et al. | 83/435.1 |
| 4,702,137 | 10/1987 | Davidson et al. | 83/731 |
| 5,224,407 | 7/1993 | Koch et al. | 83/718 |

FOREIGN PATENT DOCUMENTS

| | | | |
|---|---|---|---|
| 0413699 | 3/1946 | Italy | 83/719 |

*Primary Examiner*—Richard K. Seidel
*Assistant Examiner*—Allan M. Schrock
*Attorney, Agent, or Firm*—Herbert Dubno; Andrew Wilford

[57] ABSTRACT

The sliceable product of an automatic slicing machine is advanced toward the stop plate by a slider which is engaged on both sides of the receiving surface for the sliceable product by respective belt drives.

9 Claims, 1 Drawing Sheet

SLICEABLE PRODUCT CARRIAGE FOR A SLICING MACHINE

CROSS-REFERENCE TO RELATED APPLICATIONS

This application is a file-wrapper-continuation of patent application Ser. No. 08/077,884 filed 15 Jun. 1993, now abandoned, with a claim to the priority of Austrian application A 1218/92 itself filed 15 Jun. 1992.

FIELD OF THE INVENTION

My present invention relates to a sliceable-product carriage for a slicing machine and, more particularly, to a slicing machine which has a carriage in which the sliceable product, for example a sausage, a block of cheese or the like can be disposed and which is shiftable back and forth past the cutting edge of a blade to deposit slices upon a receiving surface. The invention especially relates to machines of this type with automatic displacement of the carriage and automatic advance of the sliceable product thereon toward a stop surface whose position with respect to the plane of the blade determines the thickness of the slice.

BACKGROUND OF THE INVENTION

In automatic machines of the aforedescribed type, the sliceable product is advanced upon the carriage automatically. For this purpose, a sliceable-product holder can be provided which usually runs along a guide bar on the carriage and is provided with a drive for advancing the holder or returning it to its starting position.

For positioning and thus for advance into the cutting position, the drive can be provided with a rapid advance portion and a slower advance portion for the actual displacement during the cutting process. The holder is usually cantilevered from the portion riding on the bar and thus is driven from only one side, the opposite side being subject to the load formed by the sliceable product.

As a result, the asymmetric forces upon the holder can cause canting and jamming thereof during advance of the sliceable product.

OBJECTS OF THE INVENTION

It is, therefore, the principal object of the present invention to provide an improved sliceable-product carriage for a slicing machine whereby these drawbacks are obviated.

Another object of the invention is to provide a sliceable-product carriage in the context of a slicing machine of the type described, especially an automatic slicing machine, which assures uniform advance of the sliceable product with symmetry of forces acting upon the member engaging same so that jamming or retardation of the advance do not occur.

Yet another object of the invention is to provide a slicing machine, especially an automatic slicer, with more uniform feed of the sliceable product toward the stop surface.

SUMMARY OF THE INVENTION

These objects and others which will become apparent hereinafter are attained, in accordance with the invention by providing the slider which engages the sliceable product from behind and rides above the receiving surface of the carriage with drive elements on opposite sides of the receiving surface on the support or carriage which receives the sausage, wurst or cheese body to be slices and which is driven by a common drive. The drive elements engage the opposite ends of the slider which thus bridges the drive elements.

Advantageously, the drive elements are belts and preferably toothed or carved belts while the common drive is a motor which is coupled to toothed or carved wheels over which the belts pass on opposite sides of the receiving surface.

Because of the symmetrical force distribution upon the slider and from the slider to the sliceable product, a uniform reliable advance of the sliceable product and a precise cutting process can be obtained.

The slider which is connected at its ends to entrainers which themselves are driven by the carved belts are easily removed for cleaning.

Advantageously, the carriage can be a one-piece trough displaceable relative to the blade disk and formed with parallel side walls flanking the receiving surface and which are hollow. The drive elements, especially the carved belts, can be received with the respective toothed wheel over which these belts pass in the hollow side walls. The entire structure can be formed from stainless steel sheet, without gaps or crevices in which contaminants can accumulate. This is of considerable advantageous with respect to the hygiene and the cleaning process.

For cleaning, the carriage can be tiltable about a horizontal axis parallel to its direction of movement and laterally on the machine and can be cleaned by a conventional steam jet unit as is customarily provided for slicing machines.

According to a feature of the invention, below the receiving surface of the carriage, an electric motor is provided which has a transmission formed with an output or drive shaft whose opposite ends carry respective toothed rollers or wheels about which the respective carved belts pass. It has been found to be advantageous, moreover, to provide the electric motor with a controller which, upon some interference with the continuity of advance of the slider, is responsive to the speed change from the drop in the rate of advance below a threshold value, for example, e.g. upon engagement of the slider with the stop plate or by the slider or the sliceable product encountering the hand of an operator, to cut off the electric motor.

The slices can be deposited on the receiving table in any desired pattern or configuration.

According to the invention, after start-up of the machine, the slider can move rapidly from a fully retracted position toward the stop plate. In this movement, it encounters the sliceable product and entrains it toward the stop plate.

The control of the motor is so effected, according to the invention, that until a resistance threshold is reached, the motor is driven with constant speed. When this threshold is reached and the speed is slowed by an obstacle as previously described, the controller can shut down the electric motor. The sliceable product can be accelerated toward the slicing position at high speed and then advanced at a slower speed for the cutting operation.

By reducing the speed during cutting, the advance of the sliceable product can be effected with precision so that all of the slices have the same desired thickness.

It has been found to be advantageous, moreover, to reduce the friction encountered by the sliceable product on the receiving surface by making that receiving surface from rolling elements. According to a feature of the invention, therefore, a separate unit, e.g. a frame, provided with rollers can be removably mounted on the carriage to form the receiving surface. The removability of the frame allows it and the rollers to be separately cleaned.

More particularly, a sliceable-product carriage according to the invention can comprise:

a support shiftable along a path of the carriage generally parallel to a stop surface and to a blade of the slicing machine;

a receiving surface on the support for receiving a sliceable product;

a slider guided on the support above the receiving surface for urging the sliceable produce toward the stop surface;

respective drive elements on opposite sides of the sliceable product on the receiving surface and engaging opposite ends of the slider for displacing the slider toward the stop surface, the slider bridging the drive elements and the opposite sides; and common drive means for the drive elements.

The slicing machine in which the carriage is incorporated can comprise:

a machine housing;

a slicing blade mounted on the housing and rotatable to slice a sliceable product;

a slice-deposition surface on the housing on one side of the blade;

means forming a stop surface against which the sliceable product can be fed to determine a slice thickness; and a carriage shiftable along a path parallel to the stop surface and to the blade of the slicing machine, the carriage comprising:

a support, means for shifting the support along the path, a receiving surface on the support for receiving the sliceable product, a slider guided on the support above the receiving surface for urging the sliceable produce toward the stop surface, respective drive elements on opposite sides of the sliceable product on the receiving surface and engaging opposite ends of the slider for displacing the slider toward the stop surface, the slider bridging the drive elements and the opposite sides, and common drive means for the drive elements.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
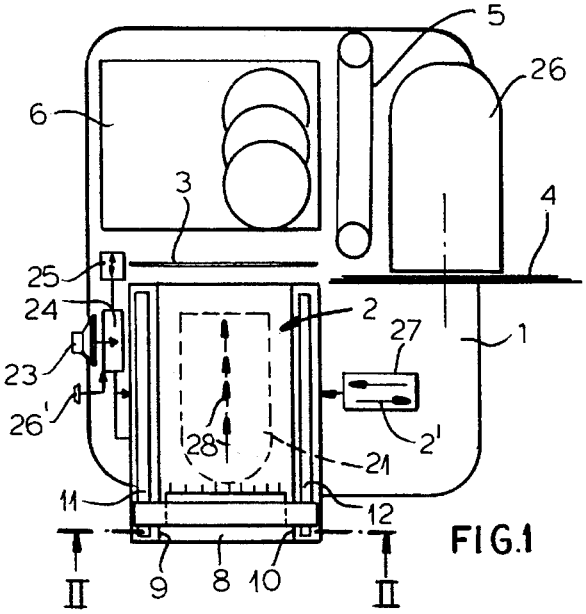
FIG. 1 is diagrammatic plan view of a slicing machine according to the invention.

The slicing machine of FIG. 1 comprises a housing or frame 1 upon which the carriage 2 is displaceable along a stop plate 3 relative to a blade disk 4 by a reversible drive in the direction of arrow 2', the drive being represented at 27.

The slice can be picked up by a conveyer chain 5 and deposited upon a collection table or platform 6.

The carriage 2 can be provided with an undercarriage (not shown) which is reversibly driven by a belt drive, a crank drive or a spindle operated by an electric motor, none of which has been illustrated since the means for reciprocating the carriage across the edge of the blade is well known in the art.

The carriage, upon release of a lock or detent, is tiltable about an axis which coincides with the section line II—II of FIG. 1 relative to its undercarriage.

Figure 2:
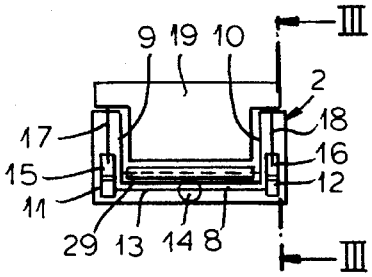
FIG. 2 is a diagrammatic section along the line II—II of FIG. 1.
Figure 5:
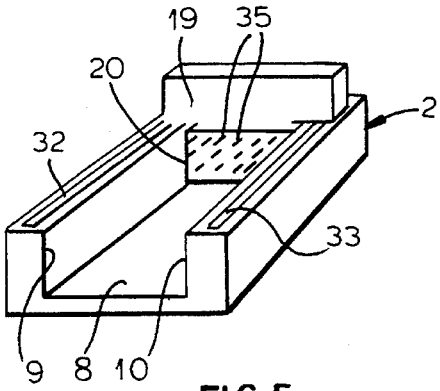
FIG. 5 is a perspective view of the carriage from the end thereof turned toward the stop plate.
Figure 4:
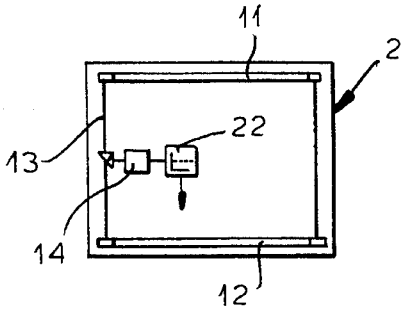
FIG. 4 is a bottom plan view of the carriage.

As can be seen from FIG. 2, the carriage 2 has a form of a trough with a receiving surface 8 along its bottom and bounded by a pair of parallel side walls 9, 10 (FIG. 5).

Receiving surface 8 and side walls 9, 10 are formed in one piece from stainless steel sheet. The crevice-free configuration is especially advantageous from the viewpoint of hygiene.

Figure 3:
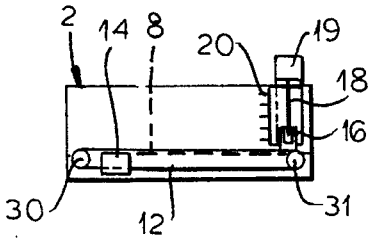
FIG. 3 is a section along the line III—III of FIG. 2.

In the hollow side walls 9, 10, respective drive elements in the form of belt-drives 11, 12 (FIG. 3) are provided. The belt drives 11 and 12 are driven by a common shaft 13 operated by an electric motor 14 via a transmission (not shown).

At the ends of the shaft 13, which extends parallel to a slider 19 and perpendicular to the direction of advance 28 of the sliceable product 21, toothed wheels 31 are provided around which the carved belts of the belt drives 11, 12 pass, At the ends of these belt drives proximal to the stop plate 3, the belts pass around additional wheels 30.

Each of the belt drives 11, 12 is provided with an entrainer 15, 16 in which coupling members 17 and 18 rigidly affixed to the respective ends of the slider 19 can removably engage.

The members 17 and 18 simply drop into the entrainers 15 and 16 which are upwardly open sockets. The walls 9 and 10 can be formed with slots 32 and 33 through which the members 17 and 18 pass to engage in the respective sockets.

The slider 19 is thus drawn by the belts along the side walls 9, 10 via the entrainers 15, 16 and the coupling members 17, 18 in a direction which depends upon the direction in which the reversible electric motor 14 is driven.

The slider 19 has an end plate 20 formed with pins 35 engaging the sliceable product 21 after an initial rapid displacement against the stop plate 3.

The motor 14 is provided with a controller 22 which maintains a constant speed for the slider during the slicing action. The slider 19 thus advances the sliceable product uniformly toward the plate 3 after the initial rapid movement, thereby ensuring uniform slices. The advance can be in steps. When, however, there is an obstacle to this advance, either because the plate 19 has engaged the stop 3 or because the hand of an operator has intervened, the speed of the plate will fall below a threshold value and the regulator 22 will cut off the electric motor 14 until a reset button is pressed.

The advance can also be controlled by a slice-thickness switch 23 which can cut off the advance shortly before the reciprocating movement of the carriage for forming the slice. The advance of the sliceable product can be positively controlled by the position of the stop plate 3, used, the stop plate can be set back further from the cutting. The two-sided engagement of the slider by respective drive elements, however, allows very accurate positioning of the sliceable product and thus highly reproducible slice thicknesses are obtained.

Additional means can be provided for fixing the position of the sliceable product in the cutting region.

After the end of a slicing process, the machine controller 24 can provide a command to the motor 14 to reverse the latter and to reset the slider to its starting position as shown in FIG. 1.

Furthermore, an electric servomotor drive 25 can be provided for the stop plate 3 which can position the stop plate 3 in the plane of the blade 4 so that the cutting edge of the blade is thus masked by the plate 3 and injury from contact with this edge can be prevented.

The machine controller 24 can be switched on by the placing of a sliceable product on the carriage, by setting of the slice thickness at the slice-thickness switch 23 or by triggering of the slice-deposition program for stacking, fanning out or producing a circular pattern of the slices (when the machine is provided with suitable programming means) or by actuation of a start button 26 of the motor 14 which advances the sliceable product into the cutting position via the slider 19.

The servomotor 25 then moves the stop plate 3, for example by the thickness which is set for the slices, back from the cutter plane. The main drive 26 for the blade 4 and the drive 27 for the carriage in the direction of arrow 2' are switched on.

Before each stroke the motor 14 is briefly turned on and the sliceable product advanced by the slice thickness (short arrows). The advance can be interrupted by the controller 22 when the speed of motor 14 falls below a predetermined threshold, e.g. by engagement of the sliceable product with the stop plate. When the desired slice-deposition program is terminated, the machine control 24 initiates reversal of the motor 14 and the energization of the servomotor 25 to return the stop plate 3 to the plane of blade 4.

Figure 6:
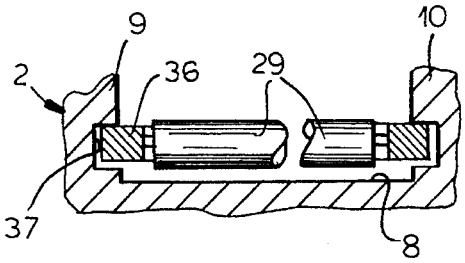
FIG. 6 is a section representing a detail showing the roller arrangement.

FIGS. 2 and 6 show that the receiving surface can be formed by rollers 29 to reduce the friction encountered by the, sliceable product 21. The rollers 29 are received in a rectangular frame 36 which is composed of stainless steel like the rollers and can be withdrawn from slots 37 in the side walls 9 and 10 as a separate element for cleaning.

I claim:

1. A food slicer comprising:

a housing;

a one-piece trough-shaped carriage defining a path on the housing and having a base defining a receiving surface adapted to hold a food article to be sliced and a pair of upwardly open hollow side walls flanking the base and extending transverse to the path;

a blade on the housing defining a blade plane parallel to the path;

a stop surface on the housing extending parallel to the blade plane but spaced therefrom by a desired slice thickness;

a slider which is displaceable in a direction transverse to the blade plane on the carriage respective and having a pair of ends above the carriage side walls;

respective endless drive belts mounted in the carriage side walls movable in a direction transverse to of the blade plane;

means including respective couplings engaged vertically between each of the drive belts and the respective slider end for connecting the slider ends to the respective drive belts; and means including a common electric drive motor for synchronously advancing the belts toward the blade plane, whereby the slider pushes the food article on the receiving surface toward the blade plane.

2. The food slicer defined in claim 1 wherein the common drive motor is an electric motor provided with respective toothed wheels over which the belts are spanned.

3. The food slicer defined in claim 2 wherein the electric motor has a shaft extending parallel to the slider and perpendicular to the walls and the respective toothed wheels are mounted on opposite ends of the shaft in the hollow housing side walls.

4. The food slicer defined in claim 1, further comprising a controller connected to the motor for shutting off the motor upon the slider encountering an obstacle in advance toward the stop surface so as to halt the slider upon impeding of the advance by a hand of an operator or an encounter with the stop surface.

5. The food slicer defined in claim 1, further comprising rolling elements on the carriage forming the receiving surface for reducing friction between the product and the carriage.

6. The food slicer defined in claim 5 wherein the carriage is provided with a removable frame carrying the rolling elements.

7. The food slicer defined in claim 1 wherein each of the walls is formed with a vertically throughgoing slot extending perpendicular to the plane and through which the couplings extend.

8. The food slicer defined in claim 1 wherein the slider is generally T-shaped.

9. The food slicer defined in claim 1 wherein the couplings include respective upwardly open sockets carried on the drive belts and respective downwardly projecting coupling elements carried on the slider ends and engageable in the respective sockets.

* * * * *